United States Patent [19]

Raines

[11] 4,313,539

[45] Feb. 2, 1982

[54] ADDITIVE CAP AND PACKAGE THEREFOR

[75] Inventor: Kenneth Raines, Bethlehem, Pa.

[73] Assignee: Burron Medical Inc., Bethlehem, Pa.

[21] Appl. No.: 159,663

[22] Filed: Jun. 16, 1980

[51] Int. Cl.[3] ..... B65D 83/00; B65D 65/16

[52] U.S. Cl. ..... 206/461; 206/445

[58] Field of Search ..... 206/461, 467, 470, 445, 206/419

[56] References Cited

U.S. PATENT DOCUMENTS

| | | | |
|---|---|---|---|
| 3,063,557 | 11/1962 | Scholl | 206/461 |
| 3,064,457 | 11/1962 | Vanden Boom et al. | 206/419 |
| 3,225,922 | 12/1965 | Straight | 206/419 |
| 3,958,710 | 5/1976 | Harding et al. | 215/254 |
| 4,126,223 | 11/1978 | Griffin | 206/445 |

*Primary Examiner*—William T. Dixson, Jr.

*Attorney, Agent, or Firm*—Shoemaker and Mattare, Ltd.

[57] ABSTRACT

A multiplicity of caps are aseptically stored in a rigid blister package, with each cap being releasably mounted on a retainer. A plurality of retainers are stored in the package. Each cap includes a clamping fin coupled to the cap skirt by a hinge which is releasably connected to that cap skirt by a pair of tear away joints and which is securely connected to the cap top wall by a living hinge which remains intact after the tear away joints are broken to release a cap from a bottle.

12 Claims, 6 Drawing Figures

12
12R
112
100
130
132
134
136
138
140
170
176
178
180
182
184
R
B
60
70
80
82
84
86
90
92
94
132
108
150
100
174
106
110
112
154
172
120
T
H

ADDITIVE CAP AND PACKAGE THEREFOR

BACKGROUND OF THE INVENTION

The present invention relates in general to bottle closures, and, more particularly, to bottle caps used for aseptic bottle capping.

Pharmacists and hospital personnel, especially nurses, are often required to cap a bottle containing solution which must be maintained aseptic. These bottles must be capped in a secure, reliable manner. On the other hand, the capping must be expeditiously carried out. The cap should also be stored in an aseptic manner.

An additional consideration in such applications is the signalling of a bottle which has been tampered with or accidentally opened. Once a cap has been removed from one bottle, that cap should not be reused.

SUMMARY OF THE INVENTION

The device embodying the teachings of the present invention is aseptically stored and securely seals a container which must be maintained in an aseptic manner. The cap embodying the teachings of the present invention is conveniently stored and expeditiously applied, yet reliably remains on a bottle. The cap provides evidence of tampering or opening of the bottle.

A multiplicity of caps are stored in a blister package in a plurality of rows. Each row of caps has a plurality of caps releasably held on a retainer member. Each cap includes a clamping fin held in the retainer member and connected to the skirt of the cap by a hinge. The hinge includes a pair of tear away joints and a living joint and is separated from the cap skirt while remaining coupled to the cap top wall to release the cap from a bottle neck. The tear away hinge joints provide evidence that the cap has been opened either completely or partially, while permitting easy removal of a snugly fit cap from a bottle.

The caps can be placed on a bottle with a minimum of contact with the cap as the retainer member is held in one hand to orient the cap over a bottle mouth. The cap is touched only to set the cap onto the bottle, with that touching being effected after the cap has contacted the bottle and thus the only part of the cap which is touched is that part which will not contact the bottle. Removal of the cap is also effected while requiring only a minimum of touching of the cap because of the hinge. The clamping fin is grasped and the tear away joints broken. The living joint holds the hinge, and hence the clamping fin, onto the cap securely enough to permit the cap to be pulled off of a bottle while grasping the clamping fin. The tear away joints prevent reuse of the cap.

The cap can be used as the sole means of closing a bottle, or in conjunction with other bottle closure means, such as rubber stoppers, or the like.

OBJECTS OF THE INVENTION

It is the main object of the present invention to permit quick, aseptic capping of manufacturer's solution bottles in one easy motion.

It is another object of the present invention to provide expeditious removal of a securely mounted cap from a bottle.

It is yet another object of the present invention to provide a cap which is efficiently yet aseptically stored.

It is still another object of the present invention to prevent reuse of a cap used to close a solution bottle.

It is a further object of the present invention to provide evidence of tampering with a cap used to close a solution bottle.

It is yet a further object of the present invention to provide a cap for a solution bottle which is adaptable for use by itself or in conjunction with other bottle closure members.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
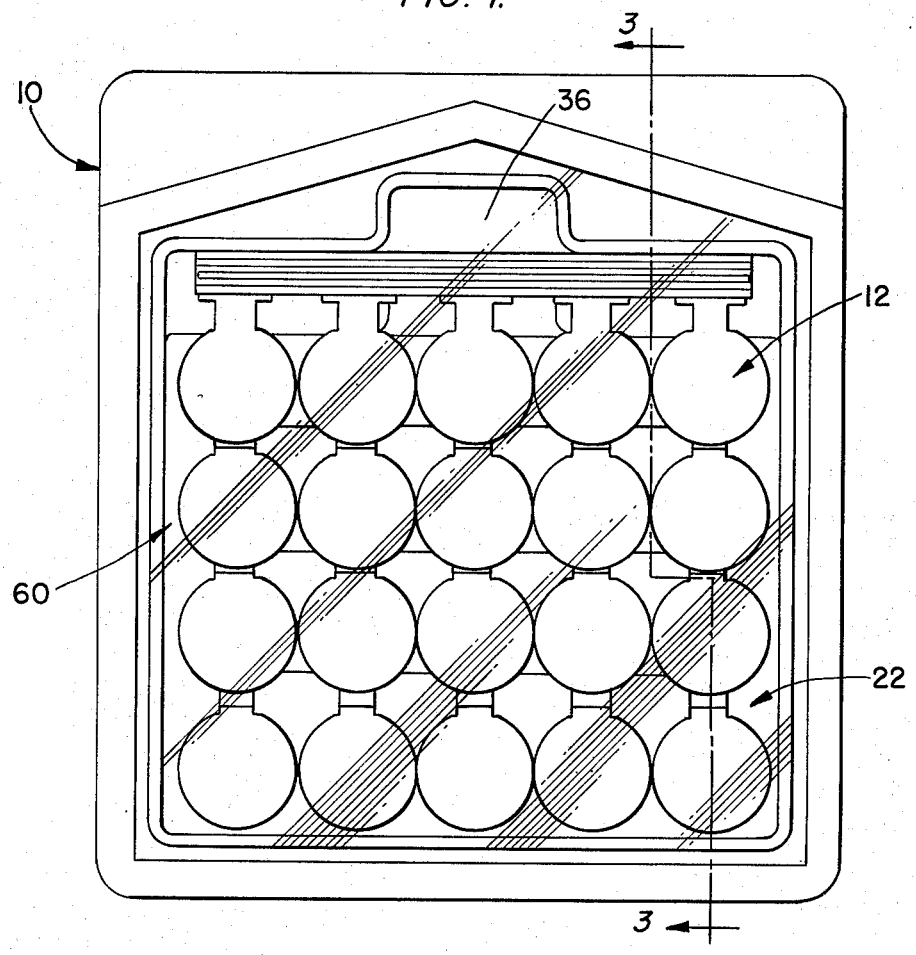
FIG. 1 is a top plan view of a package of caps embodying the teachings of the present invention.

Shown in FIG. 1 is a rigid blister package 10 containing a multiplicity of bottle caps 12 which are maintained in aseptic conditions and which are adapted to be used on solution bottles by pharmacists and hospital personnel, such as nurses.

Figure 2:
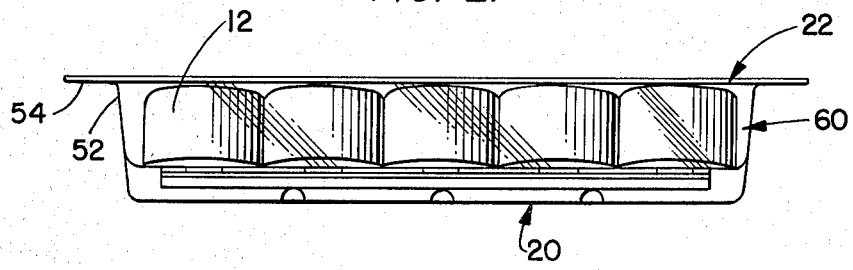
FIG. 2 is an end elevation view of the FIG. 1 package.
Figure 3:
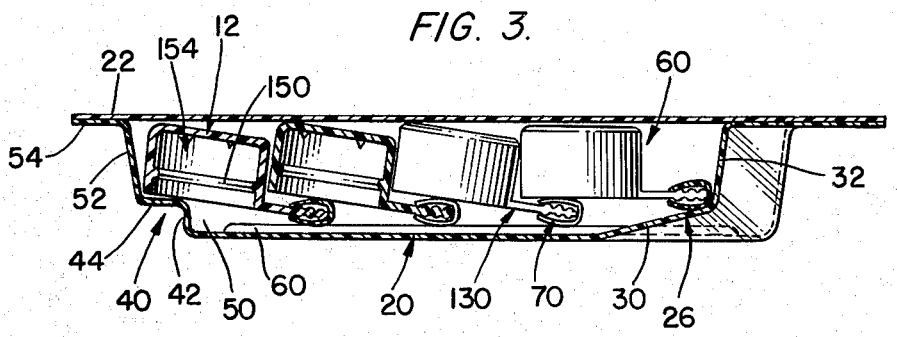
FIG. 3 is a view taken along line 3—3 of FIG. 1.

The blister package includes a base 20, which is preferably rectangular, and a lid 22 which seals that package in an aseptic manner. As best shown in FIG. 3, the package includes a pedestal 26 which has a sloped bottom 30 connected to an upright back 32. As can be seen by comparing FIGS. 1 and 3, the pedestal 26 is broken at or near the middle thereof to define an open area 36 which forms a finger hole for a purpose which will be evident from the ensuing description. A ledge 40 is formed on the end of the package opposite the pedestal and includes an upright wall 42 and a second wall 44 which is essentially at right angles with respect to the wall 42. The walls 30 and 42 are integral with the base 20 and thus define a chamber 50 within the package base. A wall 52 is integral with the wall 44 and the back 32 is part of the wall 52 to define the sides of the package 10. Top flange 54 is integral with the wall 52 and is circumambient that wall, and the package lid is affixed to this flange, as is best shown in FIGS. 2 and 3. A platform 60 is formed in the blister package chamber 50 for a purpose which will be evident from the ensuring disclosure.

It is here noted that the package 10 is disclosed as containing a multiplicity of caps 12, however, a modified form of that package can be used to contain a single cap if so desired. Such modified form will include a planar base and a sealing layer of material which covers the single cap and which is sealed to that base. The layer of material is partially peeled off of the base, and the cap is placed on a bottle by grasping the material covering the cap so that the cap is not directly touched.

Figures 4, 5, 6:
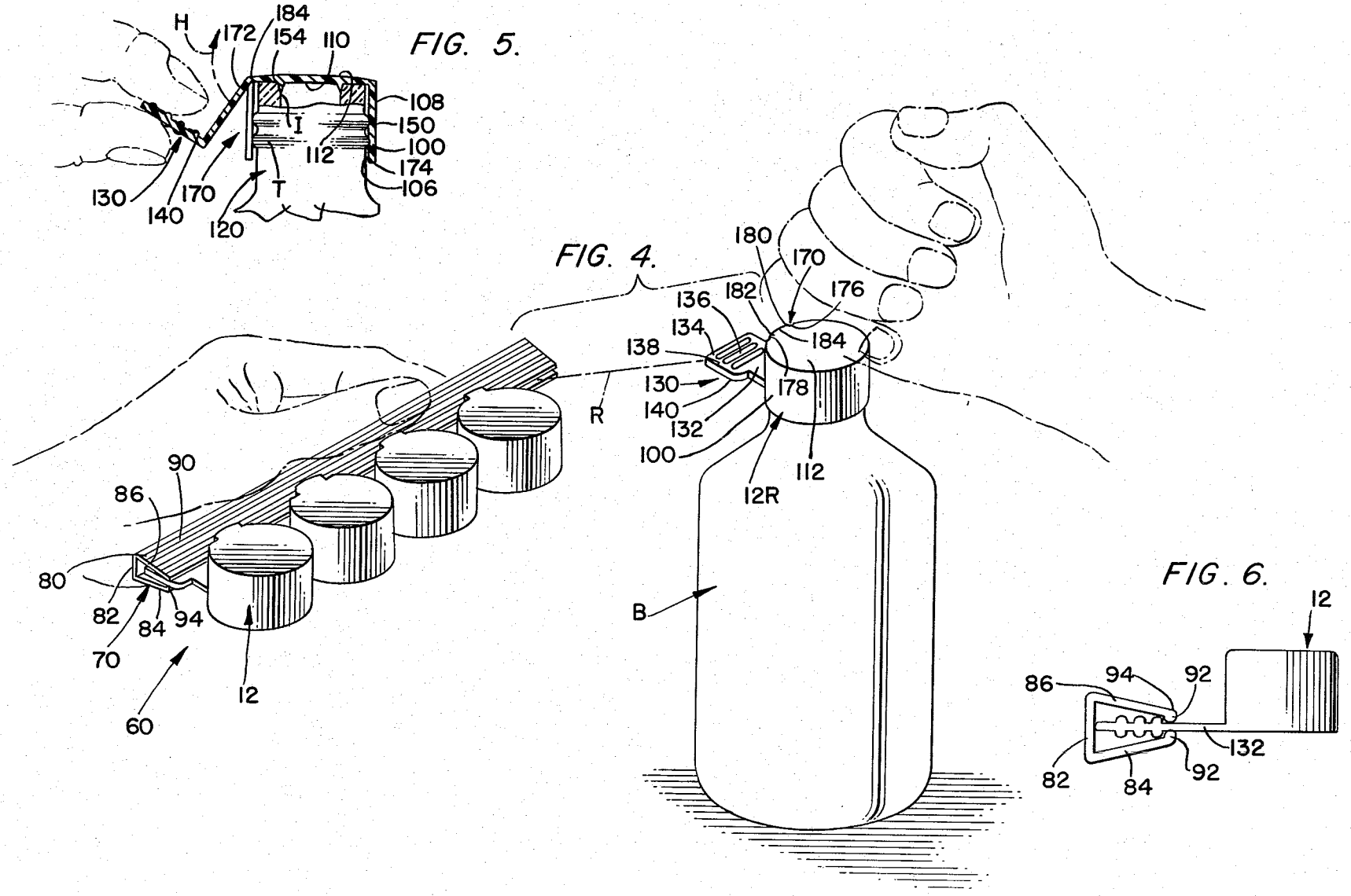
FIG. 4 is a perspective view of a cap being placed on a solution bottle in accordance with the teachings of the present invention.
FIG. 5 is a cutaway view of a cap being removed from a solution bottle in accordance with the teachings of the present invention.
FIG. 6 is an alternative form of a retainer member used in the structure embodying the teachings of the present invention.

As shown in FIGS. 1 and 4, the caps 12 are ganged together to form a plurality of cap sets 60. Each cap set 60 includes a plurality of juxtaposed individual caps, each of which is separate from the adjacent caps and each of which is releasably held on a cap retainer 70. As shown in FIGS. 1 and 3, there are a plurality of sets 60 in each package, and each set is sized to extend essentially completely across the chamber 50 with one retainer being mounted on the sloped wall 30, and being oriented to be essentially parallel to the package base. The contiguous sets are packed so the retainers are overlapped by caps and so the caps are sloped with respect to the package base. One set of caps is supported on the ledge 40.

As best shown in FIG. 4, each cap retainer includes a U-shaped bar 80 which has a web 82 to which legs 84 and 86 are integrally and unitarily attached. The legs both have outer surfaces on which corrugations 90 are defined so the retainer can be firmly grasped. The legs extend from the web toward each other and, in the FIG. 6 embodiment, have beads 92 which contact each other at the outer tips 94 thereof. The legs are biased toward each other, but the retainer is flexible so the retainer forms a clip.

An individual cap 12 is best shown in FIGS. 4 and 5, and includes an annular skirt 100 depending from a planar top wall 102. The skirt has an inside surface 106 and an outer surface 108, and the top wall has an inner surface 110 and an outer surface 112. The planar top wall can be used to contain information such as dosage, data, or the like. The skirt is preferably cylindrical in shape and snugly fits over the neck 120 of a solution bottle B to securely close that bottle.

As shown in FIG. 4, each cap includes a clamping fin 130 extending radially outward of the cap skirt. The clamping fin includes a shank 132 and a head 134 which is wider than the shank and which includes clamping ribs 136 on top surface 138 and on bottom surface 140 thereof. The ribs extend partially across the head. Identifying indicia 140 can be located on the top surface of the shank if so desired.

As best shown in FIG. 4, the cap clamping fins are interposed between the retainer legs 84 and 86 which clampingly hold the clamping fin therebetween. The clamping ribs 136 enhance the clamping operation, yet the flexible nature of the retainer permits each cap to be removed from engagement on the retainer when so desired. Such removal is indicated in FIG. 4 by the phantom line R connecting a removed cap 12R with the cap retainer.

An individual cap is shown in FIG. 5 mounted on a bottle. As shown in FIG. 5, each cap has a catch ring 150 on the inner surface of the skirt. This catch ring stands proud of this inner surface and extends around the skirt for a substantial, although not complete, circumferential distance. The ring thus has ends which are located on either side of the shank. This catch ring registers with bottle threads T to further affix the cap onto the bottle. The cap is sized to snugly fit the neck as well. An annular ring 154 is mounted on the inner surface of the planar top wall extend toward the open bottom of the cap. This ring engages inner surface I of the bottle mouth to further secure the cap to the bottle. The bottle cap is thus triple sealed to the bottle, to-wit: the flexible skirt, the retainer ring and the annular ring 154 all insure a snug fit of the cap on a bottle.

As shown in FIGS. 4 and 5, each cap has a tear away hinge portion 170 to which the shank is integrally and unitarily connected. The hinge portion includes a base 172 attached to the shank and extending at essentially right angles thereto for essentially the entire length of the skirt as measured from the skirt bottom rim 174 to the cap top wall. A pair of tear joints 176 and 178 connect sides 180 and 182 of the hinge base to the skirt, and a living joint 184 connects the hinge top to the top cap wall. The living joint permits the hinge, and hence the clamping fin, to be flexed toward the top wall as shown in FIG. 5 without separating that clamping fin from the cap top wall. The tear joints are preferably formed by forming portions of the skirt immediately contiguous the hinge base to be thin with respect to the rest of the skirt. However, perforations, or the like, can be used to define the tear joints. The living hinge joint permits the hinge to remain integral with the cap top wall even after the tear away joints have been broken.

The cap is set onto a bottle by removing the cap set from a package, placing a cap on a bottle, forcing the cap over the bottle neck and pulling the cap from the cap retainer. That cap is removed from a bottle by tearing the tear joints to free the hinge 170, lifting the hinge upwardly toward the cap top wall as shown in FIG. 5 by arrow H and removing the cap from the bottle. Freeing the hinge by tearing the tear joints release the cap from the above-described snut fit to permit easy removal of the cap.

The hinge portion 170 permits a cap to be held on a bottle snugly enough so that the bottle will remain securely closed even if dropped, yet permits easy removal of that cap from the bottle. The triple fit of the cap on the bottle insures such snug, yet easily established fit, and the tear joints provide evidence that the cap has been opened to insure the integrity of the capped bottle.

The finger hole defined in the blister package permits the first cap set to be removed from the blister package without requiring the caps in that first row to be touched. The orientation of the remaining rows, as shown in FIG. 2, permits ensuing rows to be removed by grasping the now exposed retainer members. Thus, all of the cap rows can be removed from the blister package without requiring the touching of any of the caps.

Preferably, the caps and cap retainers are formed from plastic type materials, such as non-toxic polyethylene plastic, or the like, but other materials can be used without departing from the scope of the present disclosure.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A closure means for closing solution bottles in an aseptic manner comprising:

a blister package;

a plurality of cap retainer members in said package;

a plurality of caps on each retainer member, each cap including a hinge portion defined by tear away joints and a living joint and a clamping fin attached to said hinge portion, said clamping fin being releasably held by said each retainer member.

2. The closure means defined in claim 1 wherein said each cap includes a planar top wall and an annular skirt depending from said top wall, said hinge extending for essentially the entire length of said skirt.

3. The closure means defined in claim 2 wherein said hinge portion is unitary with said top wall and remains unitary with said top wall after said tear away joints are broken to remove said each cap from a bottle.

4. The closure means defined in claim 3 wherein said hinge includes a base portion which forms a portion of said cap skirt and which is integral with said clamping fin.

5. The closure means defined in claim 1 wherein said clamping fin includes a head portion having ribs defined thereon.

6. The closure means defined in claim 1 wherein each cap includes a planar top wall and a skirt depending from said top wall and a catch ring on said skirt for engaging threads on a bottle neck.

7. The closure means defined in claim 6 wherein each cap further includes an annular ring on said top wall for engaging a bottle mouth when said each cap is mounted on such bottle.

8. The closure means defined in claim 1 wherein said retainer member is elongate and is U-shaped having a pair of legs which are biased into contact with each other for releasably holding a clamping fin therebetween.

9. The closure means defined in claim 1 wherein said blister package is rigid.

10. The closure means defined in claim 9 wherein said blister package includes a pedestal and a ledge for supporting a retainer member and a plurality of caps respectively.

11. The closure means defined in claim 10 wherein said blister package includes a finger hole defined in said pedestal for grasping said retainer member supported on said pedestal.

12. The closure means defined in claim 10 wherein said blister package includes a base, a wall, a flange circumambient said wall and a lid affixed to said flange.

* * * * *